United States Patent [19]

Stob

[11] Patent Number: 4,959,935

[45] Date of Patent: Oct. 2, 1990

[54] ADJUSTABLE STAIRWAY

[76] Inventor: H. Richard Stob, 1954 Hall St., S.E., Grand Rapids, Mich. 49506

[21] Appl. No.: 411,922

[22] Filed: Sep. 25, 1989

[51] Int. Cl.[5] ..... E04F 11/00

[52] U.S. Cl. ..... 52/183; 182/156

[58] Field of Search ..... 52/182, 183, 184; 182/1, 156, 106, 178, 163

[56] References Cited

U.S. PATENT DOCUMENTS

| | | | |
|---|---|---|---|
| 1,235,411 | 7/1917 | Andrews | 182/156 |
| 2,498,375 | 2/1950 | Moore . | |
| 3,367,444 | 2/1968 | Meddick . | |
| 3,626,438 | 12/1971 | Cornell . | |
| 3,713,511 | 1/1973 | Hinkle . | |
| 3,731,761 | 5/1973 | Glenn . | |
| 3,765,137 | 10/1973 | Loix . | |
| 3,885,365 | 5/1975 | Cox . | |
| 3,962,838 | 6/1976 | Cox . | |
| 4,124,957 | 11/1978 | Poulain . | |
| 4,406,347 | 9/1983 | Stathopoulos | 52/183 |
| 4,421,206 | 12/1983 | Kummerlin . | |
| 4,593,503 | 6/1986 | Koslowski . | |
| 4,642,953 | 2/1987 | DeGood . | |

FOREIGN PATENT DOCUMENTS

| | | | |
|---|---|---|---|
| 048946 | 4/1974 | Australia . | |
| 32594 | 12/1962 | Finland | 52/183 |
| 2405342 | 4/1979 | France . | |
| 2023204 | 12/1979 | United Kingdom . | |

*Primary Examiner*—John E. Murtagh

*Attorney, Agent, or Firm*—Price, Heneveld, Cooper, DeWitt & Litton

[57] ABSTRACT

A prefabricated adjustable stairway having a pair of opposed stacked stringers supporting each step. A stair support bracket is pivotally attached to each top stringer and is connected by an associated link to the supporting bottom stringer. Each step is mounted on an opposed pair of brackets. Sliding movement of the top stringer on the bottom stringer is used to adjust each step to a horizontal plane regardless of the inclination of the stairway. The steps can then be fixed in this position.

8 Claims, 2 Drawing Sheets

FIG. 1
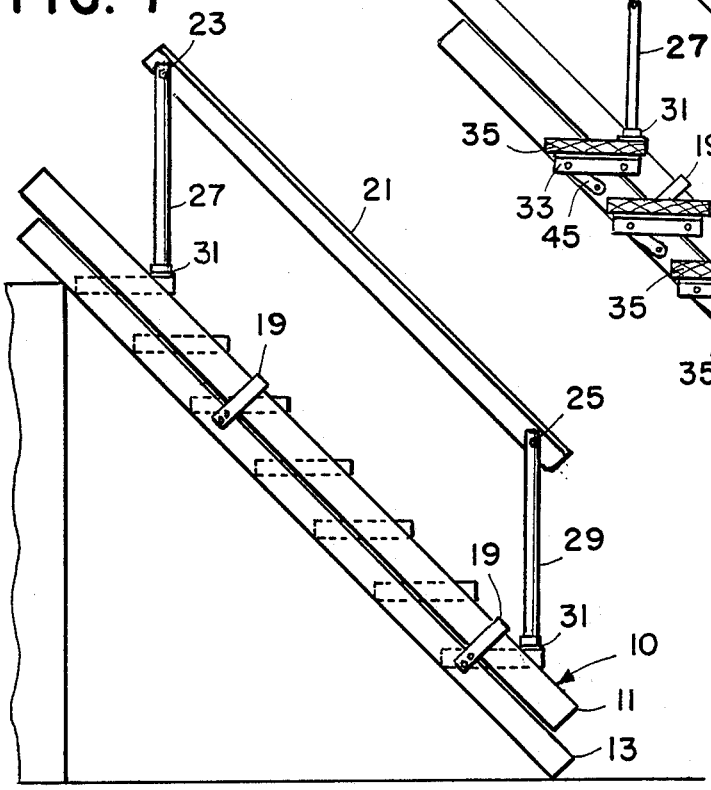
FIG. 2
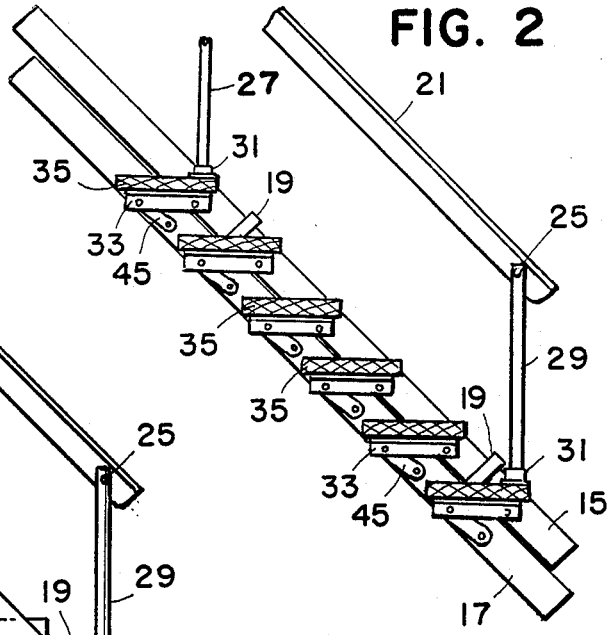
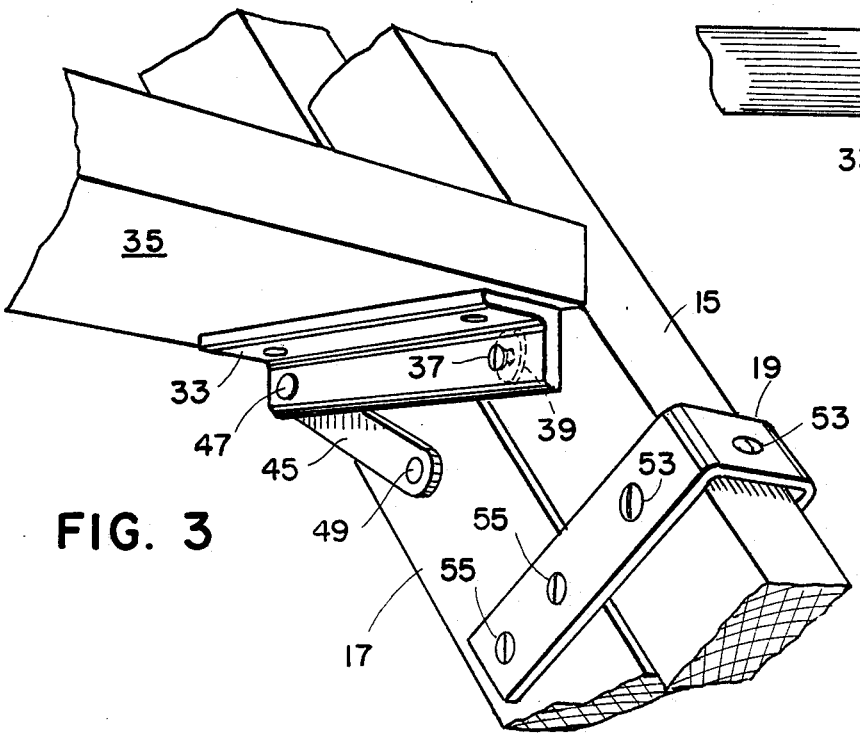
FIG. 3
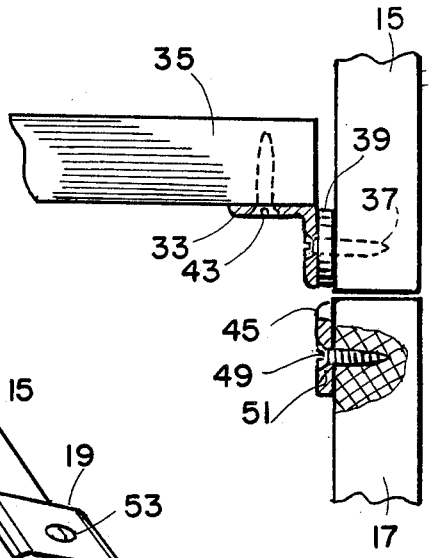
FIG. 4

ADJUSTABLE STAIRWAY

BACKGROUND OF THE INVENTION

There are many different types of adjustable stairways presently available For example, there is the familiar steel parallelogram configuration having four spaced stringers adjustably supporting the steps. This type is frequently used as a temporary stairway for a building or home. Adjustable stairways are also common on docks which undergo a rising-and-falling motion due to the change of tide. In all of these adjustable stairways, the stringers or side supports of the stairs are spaced in a parallelogram-type configuration with the pair of stringers on each side which support the steps spaced from each other. While this construction does provide an adjustable stairway, the resultant structure is inherently weak since the strength of the stairway is only as good as the strength of any one of the elongated stringers making up the sides.

SUMMARY OF THE INVENTION

In accordance with the present invention, a prefabricated adjustable stairway is provided which is of substantially improved physical strength over the adjustable stairways currently known or available in the prior art. The stairway incorporates a pair of stacked stringers for supporting the steps. In adjusting the stairway, the upper stringer of the pair is moved along and is in continual contact with the bottom or supporting stringer. The stairway thus has two substantial boards mounted on edge to provide strength In effect, the stairway has a top stringer for each side. The top stringer is supported by a bottom support stringer which extends along and can be the same length as the top stringer. A plurality of spaced opposed brackets are pivotally fastened to each top stringer. A link connects each of these brackets to the bottom or support stringer. Steps are then mounted on top of each opposed pair of brackets forming the stairway. On each side of the stairway fastened to the bottom or support stringer is a channel-shaped guide through which the top stringer moves. The stairway is so constructed that when set at any inclination against a floor or an embankment, the horizontal plane of all of the steps can be simultaneously adjusted by sliding the top stringer relative to the bottom support stringer. When the point is reached where the steps are in a horizontal plane, screws, bolts, nails, or any other type of suitable fastener can be driven through apertures in the guide into the top stringer to hold it in place.

The stairway of the present invention is easier to install than stairways with a parallelogram configuration which require careful fastening of the four corners at each end. If the parallelogram is not fastened properly to the supporting structure, the stairway will have a tendency to twist and possibly bend or break. Also, the ends of the parallelogram either have to be supported against the face of a support or a means has to be provided to stabilize the open structure In contrast, the adjustable stairway of the present invention can merely be leaned against a support. The upper stringer is slid along the lower stringer until the stairs are level The stringers are then fastened together to maintain the spatial relationship of the piece All of this can be done without fastening any portion of the stairway to the supporting structure. The parallelogram structure has to be fastened to a support or fastened in some manner to hold it in the open condition or else it can not be used.

BRIEF DESCRIPTION OF THE DRAWINGS

FIG. 1 is a side elevational view showing the stairway leaning against an elevated edge;

FIG. 2 is a sectional view through the stairway of FIG. 1 showing the steps along with support brackets for the steps and handrail;

FIG. 3 is an enlarged fragmentary perspective view showing a bracket for mounting a step and a guide for the top stringer;

FIG. 4 is an end elevational view showing the bracket of FIG. 3 attached to the top stringer and the link attached to the bottom stringer;

DETAILED DESCRIPTION OF THE PREFERRED EMBODIMENT

Figure 5:
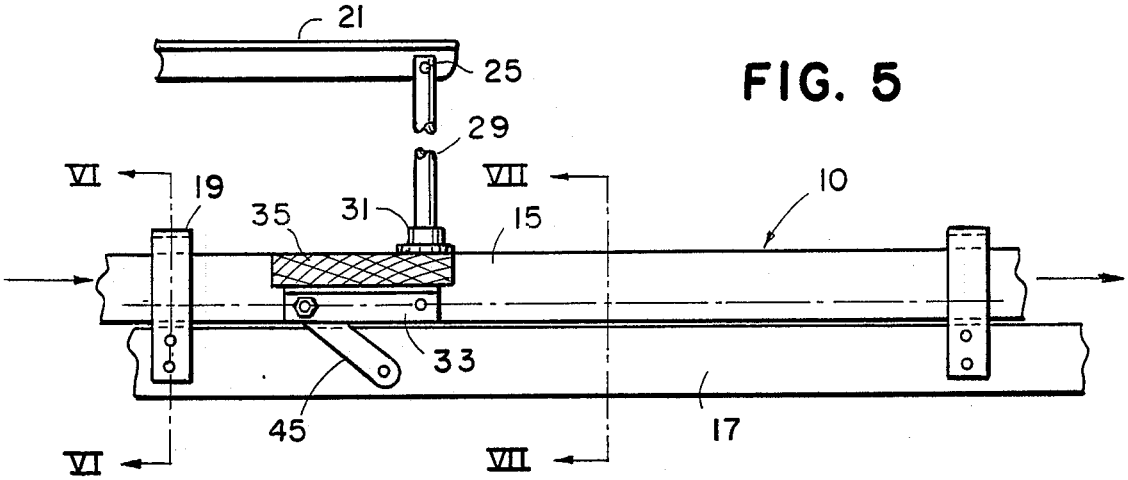
FIG. 5 is a side elevational view showing the stairway in a collapsed or folded condition.

Referring to FIG. 1, the adjustable stairway is shown and indicated generally by the number 10. The stairway can be made out of many different types of materials, such as, steel, aluminum, composite plastics and wood with wood being preferred. The stairway has a pair of stacked lateral stringers at each side. In FIG. 1, top stringer 11 is shown in sliding contact with bottom or support stringer 13. In FIG. 2, which is the side of the stairway 10 not shown in FIG. 1, a top stringer 15 is slidably mounted on a lower support stringer 17. The stringers can be made of two by fours, actually one and five-eighths by three and one-half ($1\frac{5}{8}\times3\frac{1}{2}$) inches, mounted in edge-to-edge contact for increased strength. On each of the two pairs of stringers, guides 19 are provided so that each top stringer will be guided as it slides along the upper surface of the associated bottom stringer. The guides 19 have apertures in line with the inside and the outside of each upper stringer as well as the top of the stringer. These apertures are used as passages through which screws, bolts, nails, or other fasteners can be used to fix the relationship of the top and bottom stringer when the stairway has been set in position and the steps have been adjusted to the horizontal plane. A carpenters level resting on one step can be used to simultaneously adjust all of the steps.

As shown in FIGS. 1 and 2, a handrail 21 can also be installed on the stairway. The handrail is pivotally attached at 23 and 25 to upstanding support members 27 and 29. Similar pipe supports or bottom flanges 31 are used to fix the upstanding members to the top of each supporting step. In view of the pivotal mounting of the handrail 21, the handrail will continue to retain its proper relationship to the stairways. The upstanding members 27 and 29 move as steps are adjusted.

Figure 7:
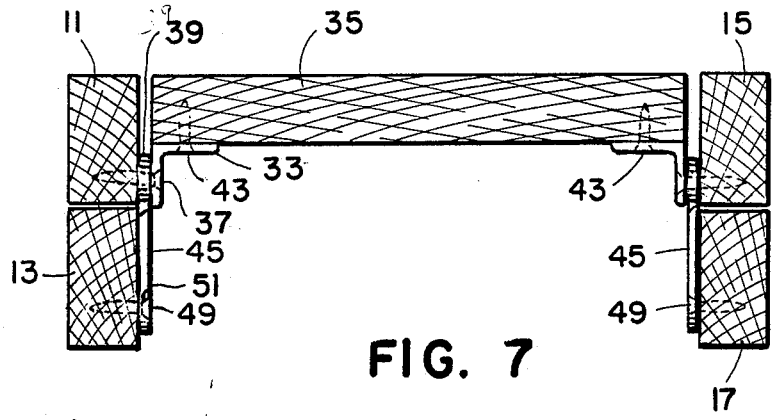
FIG. 7 is a sectional view along the lines VII—VII of FIG. 5 showing a stair mounted on brackets and fastened at each end to the top and bottom stringers.

Now referring to FIGS. 2 and 3, angle brackets 3 preferably made of galvanized steel are used to support each end of each step 35 of the plurality of steps making up the stairway. Each angle bracket is preferably made of galvanized steel and is one-eighth ($\frac{1}{8}$) of an inch thick and one and one-fourth (1¼) inches wide as measured on the outside of each face. The angle brackets can also be made of other materials, for example, aluminum alloy. The bracket 33 is fastened to the inside of each of the upper stringers 11 and 15 by a fastener 37. The bracket is pivotally mounted at this point and a spacer 39 is used to prevent the edge of the angle bracket from digging into the side of the stringer The fastener 37 is preferably a flathead screw as shown in FIG. 3. Each of the steps 35 is fastened at each end by a pair of flathead wood screws 43, as best shown in FIG. 7. For a conventional 2 by 10 wooden tread, a one and one-half (1½) inch No. 14 flathead screw is preferable for attachment of the brackets to the step. The length of the bracket can be adjusted to fit the width of the step. Again, for a conventional 2 by 10 step, the bracket would be approximately seven and one-half (7½) inches long with four (4) apertures therein approximately one (1) inch from each end of the bracket and approximately one-half (½) inch in from the outer edge of the bracket. The edge of each aperture should preferably be chamfered on the side facing the head of the fastener to allow the head of the fastener to be flush or recessed A pivot link or strap 45 is pivotally attached to the remote end of each bracket 33 by a fastener 47 which can be a bolt and nut combination or preferably a rivet as shown in FIG. 3. The opposite end of the link 45 is pivotally attached to its associated bottom stringer by a fastener 49 which is preferably a one and one-half (1½) inch No. 14 flathead wood screw. The wood screw 49 can fit into a chamfered area 51 on the link 45 so that its head is flush with the surface of the link facilitating a complete folding of the bracket 33 over the link 45. The links are preferably made of galvanized steel approximately five (5) inches long by three-fourths (¾) inch in width and one-eighth (⅛) inch in thickness. The apertures are on four-inch center in approximately one-half (½) inch from each end of the link along the center line of the link. The apertures can be chamfered on the side facing the head of the fastener.

Figure 6:
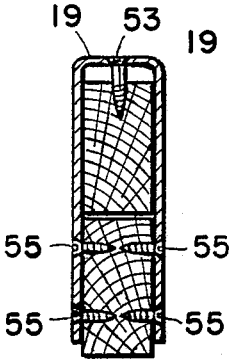
FIG. 6 is a sectional view taken along the lines VI—VI of FIG. 5 showing the guide fastened to the top stringer and bottom support stringer.

As shown in FIG. 3, the stairway has been adjusted so that each of the steps is level with the horizontal and screws 53 have been placed through the apertures in the guide 19 to firmly fix the upper stringer in its position relative to the lower stringer. A similar screw is used on the opposite side of the guide, not shown, to support the upper stringer. The guide 19 is fastened to the lower stringer by four identical screws 55 with two being inserted through the guide and into the stringer on each side of the stringer. As shown in FIG. 6, during the initial adjustment, a single screw 53 can be inserted through the top of guide 19 to hold the upper stringer temporarily in place. It is also possible to replace the screw 53 with a large nail which can be driven in to hold the stringer in place. The nail then provides a pilot hole for the screw 53 when the upper stringer is to be fastened permanently in position.

The stringers used on each side of the stairway can be prepared simultaneously by first drilling a hole in the upper stringer two (2) inches in from the end and one and three-eighths (1⅜) inches up from the bottom edge. The top stringer should then be inverted and the hole in this stringer should then be aligned with a spot four and three-fourths (4¾) inches in and one and three-eighths (1⅜) inches down from the top edge. The boards can then be clamped together and the hole drilled through the bottom stringer using the previously drilled hole as a guide. For a conventional two (2) inch by ten (10) inch tread, a hole is drilled through both stringers every ten and one-half (10½) inches. The stringers can then be separated and used to assemble the stairway.

Figure 8:
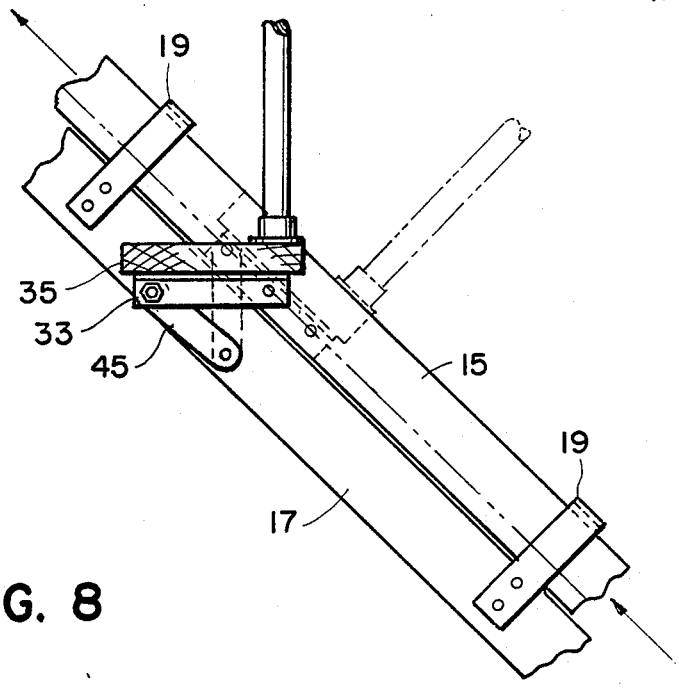
FIG. 8 is a side elevational view showing the tilting of the stair step and the handrail brace as the top stringer is moved along the bottom stringer.

Referring to FIG. 5, the stairway 10 is shown in a folded condition with the top surface of the step 35 in line with the top edge of upper stringer 15. While in this flattened condition, the handrail 21 can be added if desired. A pipe flange 31 can be fastened to the top surface of the step 35 with wood screws. The pipe 29 can then be threaded into the flange. A pivot pin or fastener 25 such as a bolt with suitable washers and a nut can be passed through an aperture in the pipe 29 and through an aperture in the handrail 21 to join the two pieces together. When the stairway is put in position at whatever angle of inclination is necessary, the stair step and handrail support will appear as shown in phantom in FIG. 8. The step 35 can be adjusted to the horizontal plane by moving top stringer 15 along the top edge of bottom stringer 17 until a carpenters level (not shown) placed on step 35 indicates that the step is horizontal. As previously discussed in relation to FIG. 6, a nail or screw can then be put through the top aperture in the guide 19 to hold the top stringer in position while all the remaining screws 53 are put in place. The handrail is also adjusted at the same time that the stair steps are adjusted The stair steps or treads can easily be moved in unison through at least 90 degrees of angle to maintain the treads level regardless of the angle of the stringers.

From the above description, it can be seen that a strong prefabricated adjustable stairway is provided which can be used in temporary or permanent indoor or outdoor applications. The stair is extremely strong and readily movable if necessary. The stairway is particularly useful in those applications where the angle of inclination or the height of the rise makes it inconvenient or extremely complicated for a stairway to be built to fit. This is particularly true of the home craftsman who does not have the tools or skills necessary to build a random angle and size stairway. This stairway can also be made to any length or cut to any length and can be used in tandem with other lengths for a multilevel stairway.

Though the invention has been described with respect to a specific preferred embodiment thereof, many variations and modifications will become apparent to those skilled in the art. It is therefore the intention that the appended claims will be interpreted as broadly as possible in view of the prior art to include all such variations and modifications.

The embodiments of the invention in which an exclusive property or privilege is claimed are defined as follows:

1. A stairway having a plurality of steps that can be simultaneously adjusted to the horizontal plane regardless of the angle of inclination of the stairway comprising:

a top stringer for each side of said stairway;

a bottom support stringer for slidably supporting each top stringer on each side of said stairway;

a plurality of spaced opposed brackets pivotally fastened to each top stringer;

a link connecting each opposed bracket on each of said top stringers to said bottom support stringer;

a plurality of steps, each step of said plurality of steps being mounted on a pair of said spaced opposed brackets on each of said top stringers;

at least one guide attached to each of said bottom supports for maintaining said top stringers in sliding alignment with said bottom support;

whereby said stairway can be placed at any desired angle of inclination and each step of said stairway can be simultaneously adjusted to the horizontal plane by sliding said top stringer on said bottom support stringer.

2. A stairway as set forth in claim 1 wherein the top and bottom stringer on each side of the stairway are in a sliding contact position at all times.

3. A stairway as set forth in claim 1 wherein each of said guides has apertures therein on the edge and side adjacent said top stringer.

4. A stairway as set forth in claim 1 wherein said top and bottom stringers can be locked in position after the stair level is adjusted by using fasteners into the top slider through apertures in said guides.

5. A stairway as set forth in claim 1 which is completely assembled or prefabricated.

6. A stairway as set forth in claim 1 wherein:

a pair of pipe supports are fastened to a pair of spaced steps on said stairway;

an upstanding support is mounted in each of said pipe supports; and a handrail is pivotally fastened to each of said upstanding supports.

7. A stairway as set forth in claim 6 wherein said handrail maintains its position relative to said stairway as said steps are adjusted.

8. A stairway having steps that will adjust to the horizontal plane regardless of the inclination of the stairway comprising:

a first and a second pair of stringers, each pair of stringers having an upper stringer in sliding contact with a lower stringer;

a plurality of steps mounted between said first and second pair of stringers;

a supporting bracket attached across the bottom at each end of each of said steps, said supporting bracket having a pair of spaced apertures therein with a first aperture near the front and a second aperture near the rear of each of said steps;

a fastener for each of said brackets pivotally fastening each of said steps to the upper stringers of each of said pairs of stringers through the first aperture in each of said brackets;

a link pivotally connected to each of said brackets at the second aperture and also pivotally fastened to the lower stringer of each of said pair of stringers whereby each step of said plurality of steps can be simultaneously adjusted to the horizontal plane regardless of the angle of inclination of said stringers, by sliding said upper stringer along said lower stringer thereby causing each of said links to pivot its associated bracket and step about said fastener on the upper stringer of each pair of stringers.

* * * * *

UNITED STATES PATENT AND TRADEMARK OFFICE

CERTIFICATE OF CORRECTION

PATENT NO. : 4,959,935

DATED : October 2, 1990

INVENTOR(S) : H. Richard Stob

It is certified that error appears in the above-identified patent and that said Letters Patent is hereby corrected as shown below:

Col. 1, line 6;
After "available" insert --.--;
Col. 1, line 32;
After "strength" insert --.--;
Col. 1, line 61;
After "structure" insert --.--;
Col. 1, line 64;
After "level" insert --.--;
Col. 1, line 66;
After "piece" insert --.--;
Col. 2, line 64;
"brackets.3" should be --brackets 33--;
Col. 3, line 8;
After "stringer" insert --.--;
Col. 3, line 23;
After "recessed" insert --.--;
Col. 4, line 27;
After "adjusted" insert --.--.

Signed and Sealed this

Twenty-first Day of April, 1992

*Attest:*

HARRY F. MANBECK, JR.

*Attesting Officer*

*Commissioner of Patents and Trademarks*